United States Patent [19]

Verini

[11] 4,114,160

[45] Sep. 12, 1978

[54] AUTOMOBILE ANTENNA MOUNTING BRACKET APPARATUS

[76] Inventor: Anthony J. Verini, 30 Lenox Ave., Green Brook, N.J. 08812

[21] Appl. No.: 762,442

[22] Filed: Jan. 26, 1977

[51] Int. Cl.[2] ..... H01Q 1/32

[52] U.S. Cl. ..... 343/715; 248/539

[58] Field of Search ..... 343/711, 712, 713, 715; 248/539

[56] References Cited

U.S. PATENT DOCUMENTS

| | | | |
|---|---|---|---|
| 4,028,705 | 6/1977 | Loyd | 343/715 |

FOREIGN PATENT DOCUMENTS

| | | | |
|---|---|---|---|
| 1,235,268 | 5/1960 | France | 343/715 |
| 1,238,407 | 7/1960 | France | 343/715 |
| 1,249,268 | 11/1960 | France | 343/711 |
| 1,216,515 | 4/1960 | France | 343/713 |
| 916,812 | 1/1963 | United Kingdom | 343/711 |

*Primary Examiner*—Eli Lieberman

*Attorney, Agent, or Firm*—Frederick W. Padden

[57] ABSTRACT

A plurality of stepped bracket configurations for mounting a CB (Citizen Band) antenna to an inner door frame of a motor vehicle, such as a car, van, truck and trailer cab are disclosed. Each illustrative bracket comprises a plurality of treads and at least one step riser. One of the treads comprises at least one hole for mounting the CB antenna thereon. A second tread comprises a pair of generally L-shaped rods extensions which cooperatively interfit with a pair of apertures in the inner door frame to guard against undesired removal of the bracket when the door is closed. Optionally, the second tread comprises an aperture for receiving a screw for insertion through a hole drilled in the inner door frame for semipermanently installing the bracket to the door frame. A spring-action handle subassembly is cooperatively mounted on the step riser for engaging a bracket member embracingly with the rain gutter of the roof of the vehicle. The disclosure includes brackets for mounting on a topmost outer extension of the vehicle door.

13 Claims, 12 Drawing Figures

AUTOMOBILE ANTENNA MOUNTING BRACKET APPARATUS

This invention relates to mounting apparatus and particularly to a family of brackets for mounting a CB antenna on a motor vehicle, such as a passenger car, van, bus, truck, and trailer cab.

Mobile CB equipment has contributed substantially to convenient and widespread communication for business, recreational, and public interest purposes. Illustratively, such equipment has specifically proven to be of great importance in quickly and conveniently alerting police and medical personnel to accidents, disabled motorists and other disasters. Extensive joint cooperation has also been developed between police and CBers in reporting traffic patterns and problems.

Despite such benefits, owners of mobile CB equipment have suffered substantial loss in and damage to transceivers, antenna and mounting brackets as well as the vehicle itself due to theft and vandalism. One factor which has proven to contribute to such loss and damage has been the public display of a CB antenna on the roof, fender, bumper, rain gutter, or trunk area of a vehicle and on the mirror of a van, truck or trailer cab. The display has been known to attract thieves and vandals to the existence of CB equipment in the vehicle and, thus, instigated undesired theft or damage when the vehicle is unattended. In light of such evidence, purchasers continually seek mounting brackets which safeguard against undesired detachment from their vehicles and which facilely permit detachment for storage of the antenna out-of-the-public view particularly when their vehicles are unattended.

Developments in the art of mounting CB antennas have progressed in recent years to the extent that a variety of arrangements are presently available for permitting the removal and concealment of the antenna from public view when no one is in the vehicle or the CB gear is not in use. Such an arrangement includes a foldable step-like mounting bracket which is permanently secured to the interior rain gutter frame of a trunk lid and is foldable to locate an antenna attached thereto into the trunk compartment when the CB is not in use. A disadvantage of the foldable bracket is that when it is folded down for storage in the trunk compartment, the antenna protrudes into the trunk space thereby interfering with the storage area of the trunk. Moreover, an antenna left in the stored position while the vehicle is in motion could be damaged if an object in the trunk accidently bounced or slid against it. A further disadvantage of the foldable type mount is that it is generally unsuitable for vehicles without trunks, for example, vans, buses, and trailer cabs.

Other CB antenna brackets involve clamping and screw fastener configurations. Among the disadvantages of the clamping brackets are that heretofore they have been too easily removed or damaged by vandals or thieves when left unattended. This has been particularly true when the clamp is simply a manual squeeze-type device. Moreover, the commercially marketed squeeze-type designs are too bulky and costly to warrant widespread use. The screw fastener-type brackets customarily are attached to a rain gutter or trunk lid of a vehicle or to the mirror of a truck or trailer cab. For this owner, these fastener arrangements have been relatively inconvenient and time consuming to remove and reinstall each time the CB is taken out of and restored to use.

Obviously, such a fastener device requires screw driver manipulations for the bracket fastening and removal. Moreover, ready access to the fastening screws makes the theft of the bracket and its antenna a facile task for the perpetrator.

In view of the foregoing, it is apparent that a need exists for a simple and inexpensive CB antenna mounting bracket which is protected against undesired removal particularly when the antenna is exposed to public view on a vehicle. Another need has been for a clamp-type bracket which is relatively nonbulky, simple and aesthetically complementary to a vehicle and yet protected against undesired removal. A specific need is for an alternative and improved mounting bracket for trucks, vans and trailer cabs which heretofore have extensively used rearview mirror mounts.

SUMMARY OF THE INVENTION

The foregoing needs are fulfilled in accordance with specific exemplary embodiments of my invention which include a family of stepped mounting brackets each of which is secured illustratively about the door or hatch opening or trunk lid compartment of a motor vehicle and is protected from undesired removal when that door hatch or trunk lid is closed. Advantageously, the brackets are suitable for use on cars, vans, trucks, buses, and trailer cabs.

According to a broad teaching of my invention, I provide a bracket for mounting, by way of example, a CB antenna to an interior portion of a motor vehicle body frame and about a barrier means (such as a door, hatch or trunk lid) which is openable to provide access to the interior of the vehicle and is closable to bar entry to the vehicle. The bracket is of a stepped configuration with a plurality of treads and at least one step riser secured between the treads. One of the treads is adapted to carry the antenna. Advantageously, I provide means defining at least one aperture through a prescribed interior portion of the frame and securing means for another one of the treads which is securable within the at least one aperture when the barrier is opened and for affixing the last-mentioned tread between the interior frame portion and the barrier means when the barrier is closed.

It is a feature of my invention that the means formed on the other one of the treads comprises at least one rod extension from that tread. The rod extension is insertable into the aperture in the interior frame when the barrier is opened and is secured within the aperture when the barrier is closed. By way of example, the rod extension comprises an L-shaped configuration extending upwardly from a top facing surface of the last-mentioned tread.

For semipermanent installation of the bracket, it is another illustrative feature of my invention that the securing means comprises an aperture in the other one of the treads and a screw fastener securable with the at least one aperture in the interior frame.

Another feature of my invention is that the bracket is securable to a rain gutter of the motor vehicle by a plate means having a riser movably secured about the step riser of the bracket and a piece extending from the plate riser for embracing the rain gutter.

An illustrative structure according to my invention is that the riser of the plate means has at least one threaded bore and the step riser of the bracket has at least one aligned slot through which a screw fastener is inserted for interfitting fastening of the plate means about the rain gutter.

A particularly advantageous illustrative structure according to my invention is that the riser of the plate means is secured to a spring-action handle subassembly which is vertically movable to admit and embracingly fasten the extending piece of the plate means about the gutter. The subassembly illustratively comprises wall means defining first and second rectangular cavities, a bar segment at a lower portion of the first cavity for defining a well and sitting area for one end of a spring. Another end of the spring abuts and compressively interacts with a rearward extension plate on the rear portion of the bracket riser and which, upon assembly, rests within the first cavity of the handle. A block piece in an upper portion of the second cavity has its outer peripheral surfaces extending through a rectangualr slot in the bracket riser. The block also contains a threaded aperture which matingly interfits with a screw fastener for movably securing the plate means to the handle.

In accordance with one specific embodiment of my invention, a simple and economical bracket is provided having an upper and lower tread interconnected by a contiguous riser. The upper tread illustratively extends above the roof of the vehicle and contains at least one conventional aperture for mounting a CB antenna. The lower tread is a flat body which has means defining at least one aperture through which a screw fastener extends to secure the bracket to an inner and upper door frame surface of the vehicle. The lower tread is sufficiently thin to allow a closure of the door without obstruction. Resultingly, when the door is closed, access to the screw fastener is precluded and hence the bracket cannot be removed.

Another exemplary embodiment is a bracket which is secured to a raised lip extension at the top portion of the vehicle door and illustratively by means of a pair of screws which extend through the bracket to an interior portion of the door extension and are nonaccessible when the door is closed. The bracket comprises an upper CB antenna mounting tread that extends illustratively above the vehicle roof and is interconnected with an off-set lower tread by means of a riser. The lower tread comprises a pair of spaced apart downwardly extending members defining a channel for matingly interfitting with the top extension of the door. An inner one of the spaced apart members is sufficiently thin so as not to obstruct the normal closing of the door. It is also equipped with a pair of thread holes which threadedly cooperate to extend the aforementioned screws into the channel for fastening the bracket onto the door extension.

It is a feature of my invention that the provision of a structure defining a wide channel on a bracket for securing it to a door at its top portion which may illustratively comprise a decorative chrome molding with inclined or curved surfaces. The structure is part of a unitary bracket which includes an upper CB antenna mounting tread, a riser extending from the upper to a lower tread, another riser inwardly and upwardly inclined from the lower tread to an intermediate tread, and a downwardly extending interior flat member. A spaced apart relationship exists between the interior member and the inclined riser to define the channel for slidably admitting the bracket over the top extension of the door. The interior member has at least one threaded bore to receive a threaded screw for threaded admission into the channel to fasten the bracket to the door top extension and, advantageously, with the antenna positioned for vertical polarization. Significantly, the thinness of the interior member of the bracket permits the nonobstructed closing of the door and, accordingly, with nonaccess to the fastening screws.

A salient feature of my invention is the provision of a bracket assembly which is removably secured to a rain gutter of a motor vehicle roof and within at least one hole drilled through a top portion of an inner door frame of the vehicle. The assembly furnishes rigid support for a CB antenna on an upper tread of the bracket and advantageously safeguards against its removal when the vehicle door is closed. The bracket contains a riser between the upper and a lower tread. A slidably movable plate is part of the assembly and is provided with an inclined extension member which embraces the gutter to secure the bracket on the vehicle. The plate also has a riser attached to an upwardly movable handle. The plate riser is slidably movable vertically and parallel to the bracket riser. The bracket is secured within the inner door frame by means of two approximately L-shaped rod extension pieces which are slidably inserted into mating apertures drilled through the top surface of the inner door frame. These rod pieces insure that the bracket is nonremovable when the door is closed.

Another feature of the exemplary embodiment is that a CB antenna cable is confined within the assembly so as not to dangle freely and be subjected to damage when the door is closed. To do so, apertures are provided in the plate and bracket risers, a passageway cavity in the spring-action handle, and a cable clamp on a lower surface of the lower thread.

It is another feature of my invention that the spring-action handle has a plurality of inner walls forming illustrative rectangularly shaped upper and lower cavities. A unitary bar element is provided at a lower exterior portion of the upper cavity at an exterior periphery thereof to closeoff a lower segment of that cavity and to define a well and sitting area for receiving and storing a spring. A block piece is secured with the lower cavity at a location abutting the bar element. A threaded aperture is provided in the block to provide for the threaded fastening of the aforementioned plate thereto by means of a threaded screw extended through another aperture in the plate riser and a rectangular slot in the bracket riser. Outwardly extending peripheral surfaces of the block project into the rectangular slot and provide for the guided movement of the subassembly in a vertical direction. The spring-action of the subassembly is accomplished partially by a plate extension on a rear surface of the bracket riser. One end of the spring rests in the sitting area of the upper cavity and another end thereof is slightly compressed against a lower surface of the last-mentioned plate extension. Movement of the handle upwardly causes the compression of the spring and the movement of the plate vertically above the gutter of the vehicle. A release of the handle causes the decompression of the spring and resultant spring urged movement of the handle and plate downward such that the gutter is embraced within the plate extension, the lower tread and the bracket riser. Concurrently the rod extension rests within the hole drilled in the top surface of the inner door frame and precludes removal of the bracket when the door is closed.

A further aspect of my invention is the provision of a bracket similar to the aformentioned bracket assembly except that the spring-action handle subassembly is not provided. Instead, in this version the bracket is movably secured to the plate riser by screw fasteners. A pair of spaced apart oval apertures are formed in the bracket riser and receive a pair of screws that matingly interfit with an aligned pair of threaded bores in the plate riser. The screws are loosely fitted within the riser bores to allow the plate to be moved vertically to clear the rain gutter of the vehicle during installation of the bracket. Thereafter, the plate is manually moved downward to embrace the gutter within the inclined plate extension, the lower tread and bracket riser. The screws are then tightened to secure the bracket and antenna on the vehicle. In this arrangement, the screws are visible and removable when the door is closed; however, the bracket is not removable at that time because the at least one rod extension in the drilled hole precludes complete bracket movement to extract the lower tread from between the door and inner door frame.

My illustrative embodiment provides an alternative or complementary means to the one or more rod extensions for precluding removal of the bracket when the door is closed. The means comprises a structure whereby an aperture is defined in the lower tread and a threaded screw is inserted therethrough into a hole drilled in the top inner door frame. This arrangement provides for an optional elimination of the rod extensions and a semipermanent installation of the bracket.

I further provide a mounting bracket suitable for use on vans, trucks, and trailer cabs. The bracket includes an upper tread for mounting a CB antenna and a riser structure for locating the antenna outwardly away from the vehicle body and above its roof. Rod extension members are secured to a lower tread which also has an aperture for screw mounting of the bracket to the top of the inner door frame. The rods also cooperate with holes drilled in the top of the inner door frame. A plate and spring-action handle subassembly are advantageously furnished for securing the bracket to the vehicle rain gutter. Removal of the bracket when the vehicle door is closed is precluded by the rod extensions and/or the screw fastener on the inner door frame.

DRAWING DESCRIPTION

My invention, together with its various features and advantages can be readily understood from the following more detailed description taken in conjunction with the accompanying drawing, in which.

DETAILED DESCRIPTION

Figure 1:
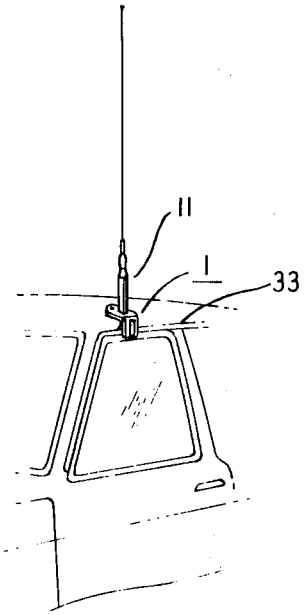
FIG. 1 depicts a CB antenna 11 on a mounting bracket 1 which is in turn mounted on the door frame assembly of a motor vehicle body.
Figure 2A:
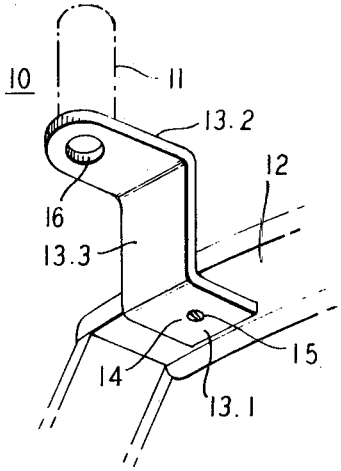
FIG. 2A is a pictorial view of a mounting bracket in accordance with one embodiment of my invention for use as in FIG. 1.

With reference to FIG. 2A, there is shown a bracket 10 for mounting an object 11, such as a CB antenna above and slightly to the side of a rigid body surface 12, such as the inner door frame surface of a motor vehicle. Bracket 10 has a stepped configuration comprising lower and upper treads 13.1 and 13.2 joined together by a step riser 13.3. Lower tread 13.1 has means defining an aperture 14 through which a fastener 15, such as a threaded screw, is inserted for rigidly securing bracket 10 to the surface 12. To do so, an aligned hole is predrilled through surface 12. Upper tread 13.2 has means defining a hole 16 used for mounting a CB antenna 11. It is within the scope of my invention to provide more than one aperture in treads 13.1 and 13.2 for fastening bracket 10 to surface 12 and for selectively mounting different size CB antenna to thread 13.2. Bracket 10 is of a thin enough gauge to provide rigid support for antenna 11 and noninterference with the closing of a door (not shown in FIG. 2).

Figure 2B:
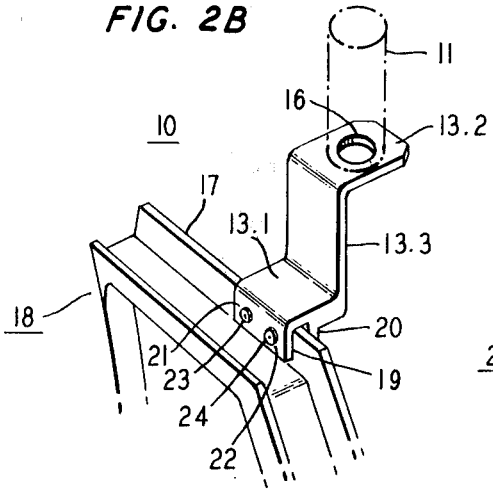
FIG. 2B shows another illustrative embodiment of my mounting bracket rigidly secured to an upper extension of the door frame of a motor vehicle.

FIG. 2B shows another version of a bracket 10 for mounting on an upper extension member 17 of a motor vehicle door 18. Bracket 10 has an upper tread 13.2 for mounting a CB antenna 11 about a hole 16. Tread 13.2 is joined as a unitary structure to a riser 13.3 which, in turn, is joined to a lower tread 13.1 Treads 13.1 and 13.2 are shown projecting in opposite directions such that antenna 11 extends outwardly away from and above door 18. Tread 13.1 has a pair of parallel spaced apart extension members 19 and 20 extending downwardly for defining a channel for matingly interfitting with the extension 17 of door 18. Member 19 faces inwardly toward the interior of door 18 and has means defining a pair of tapped holes 21 and 22 for threadedly cooperating with a pair of threaded screws 23 and 24 to fasten bracket 10 to extension 17. Screws 23 and 24 are on an inner portion of door 18 so that, when the door is closed, bracket 10 is not readily removable by theft or vandalism.

Figure 2C:
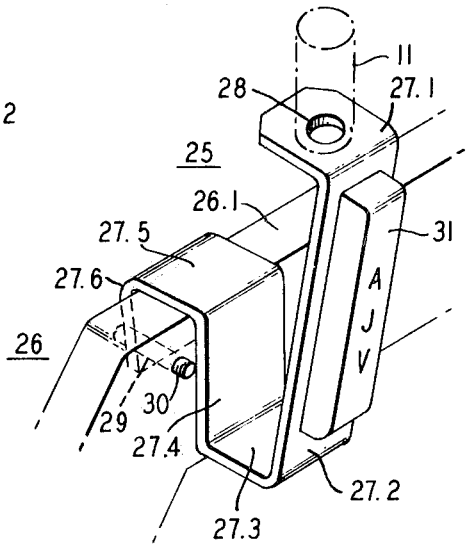
FIG. 2C depicts another exemplary version of my mounting bracket affixed to an upper peripheral chrome portion of the door frame of a motor vehicle.

FIG. 2C is yet another embodiment of a bracket 25 for mounting on a relatively thick extension member 26.1 of a door 26 and which member may comprise a tapered or curved chrome molding. Bracket 25 is a unitary structure formed of an upper tread 27.1, a riser 27.2, lower tread 27.3, an inwardly inclined riser 27.4, tread 27.5 and a downwardly extending inner member 27.6. The spaced apart relationship of member 27.6 and riser 27.4 is sufficient for slidably admitting bracket 25 over the door extension 26. The degree of incline on riser 27.4 is such that it is in surface to surface contact with facing surfaces of the door extension member 26.1, such as its tapered or curved molding and sufficiently to allow the antenna 11 to be vertical with respect to a road surface. Interior member 27.6 has at least one threaded aperture 29 to receive a threaded screw for securely fastening bracket 25 to an inner door portion of extension 26.1 and such that, when door 26 is closed, the screws are nonviewable from an exterior of a motor vehicle and removal of bracket 25 is made difficult for a thief or vandal. Bracket 25 further has a decorative plate 31 secured to an outer surface or riser 27.2. It is within the scope of my invention teaching to provide identification information, such as a CB "handle" or letters AJV, on an exterior facing surface of plate 31.

Referring to FIGS. 3 through 6B, there is depicted a bracket assembly 32 which advantageously is removably secured to a rain gutter 33 (FIG. 3) of a motor vehicle roof 34 and within at least one hole drilled in the inner door frame surface 35 of the vehicle. The assembly provides rigid support for a CB antenna 11 on an upper tread 36 of bracket 32 and protects against its removal when the vehicle door 37 is closed. Bracket 32 also comprises a riser 38 and a contiguous lower tread 39. The assembly advantageously includes a slidably movable plate 40 having an inclined extension member 40.1 which embraces the gutter 33 to secure the bracket 32 on the vehicle. Plate 40 also has a riser 40.2 which is contiguous to extension 40.1 and which is secured to an upwardly movable spring-action handle 41 as is more fully described later with respect to FIGS. 5, 6A and 6B. Riser 40.2 is slidably movable vertically and parallel to the riser 38. Bracket 32 is illustratively secured within the inner door frame by means of two approximately L-shaped rod extension pieces 42 and 43 (FIGS. 3 and 4) which are slidably inserted into mating apertures, such as aperture 44 of FIG. 3, drilled into door frame surface 35.

Figure 3:
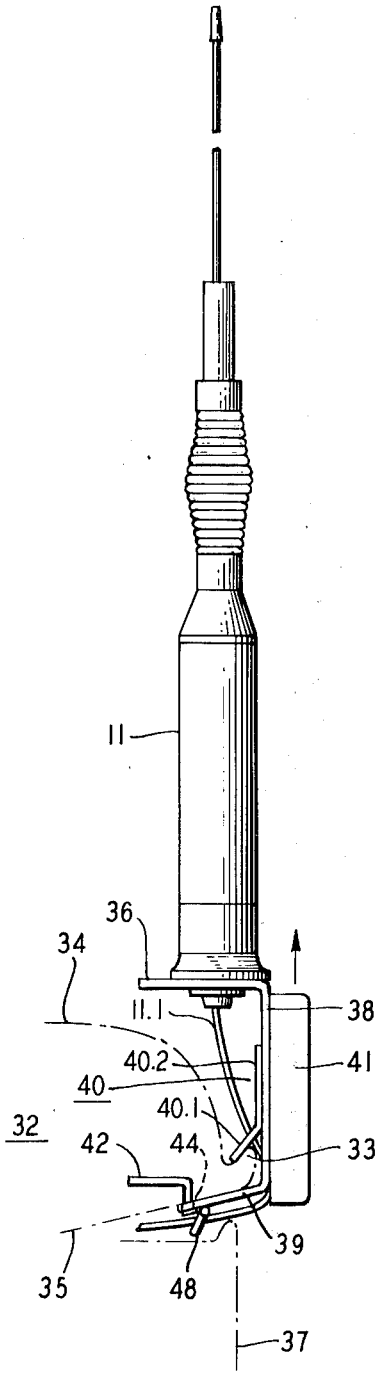
FIG. 3 illustrates a side view of a CB antenna mounted on another exemplary mounting bracket removably affixed to the rain gutter and the interior and upper door abutting surface of a motor vehicle.
Figure 4:
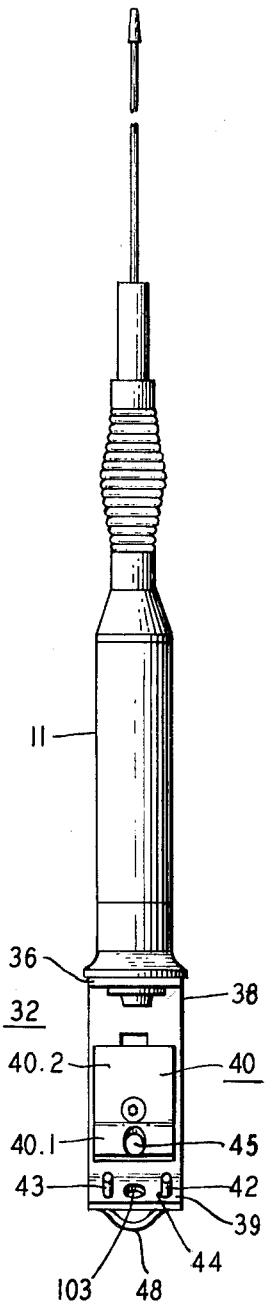
FIG. 4 shows an interior facing view of the bracket of FIG. 4.

Another advantage of the bracket assembly 32 is that a CB antenna cable 11.1 is confined within the assembly so as not to be subjected to damage when the vehicle door is closed. This is accomplished by providing an aperture 45 (FIGS. 4 and 5) in extension member 40.1, an aperture 46 (FIG. 5) in riser 38, a passageway cavity portion 47 (FIG. 5) in handle 41, and a cable clamp 48 (FIG. 3) on a lower surface of tread 39. The antenna cable 11.1 is threaded through the apertures, passageway and clamp as shown in FIG. 3.

Figure 5:
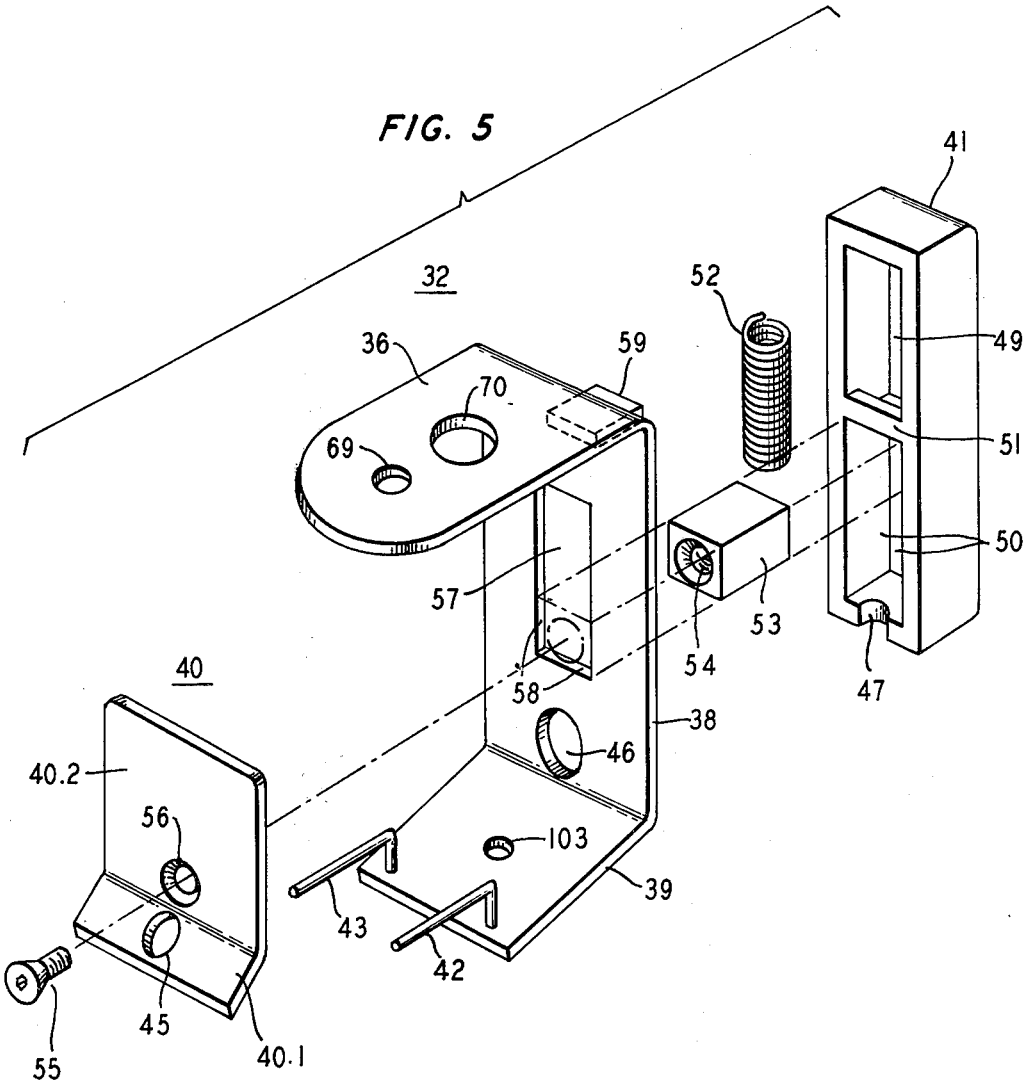
FIG. 5 is an exploded piece part view of the mounting bracket assembly of FIGS. 3 and 4.

Turning now to FIG. 5, the subassembly structure of the spring-action handle 41 is described. Handle 41 has a plurality of inner walls 49 and 50 forming generally rectangular shaped upper and lower cavities. Between walls 49 of the upper cavity and at an exterior portion thereof is a bar element 51 which closes-off a lower segment of the upper cavity and cooperates with walls 49 to define a well and sitting area for receiving and storing a spring 52. A block piece 53 is secured by friction or other known means, within the walls 50 of the lower cavity and at a location abutting the bar 51. A threaded aperture 54 is contained within block 53 to provide for the threaded fastening of plate 40 thereto by means of a threaded screw 55 extendable through another aperture 56 in riser 40.2 and a rectangular slot 57 in riser 38. When secured within the walls 50, outwardly extending peripheral surfaces of block 53 project into the walls 58 defining slot 57 and provide for the guided movement of the handle subassembly in a vertical direction. The spring action of the subassembly is achieved in part by a plate extension 59 forming part of a rear surface 60 (FIGS. 5 and 6A) of the riser 38.

To assemble the piece parts of FIG. 5, it is advantageous to secure the block 53 within the lower cavity of handle 41 as priorly explained. Next, a lower segment of the spring 52 is inserted into the well and sitting area formed by walls 49 and bar 51 while allowing an upper segment of the spring to remain outside of the upper cavity of handle 41. Then, the handle subassembly is arcuately moved so that the upper spring segment is aligned on an underside surface 61 (FIG. 6B) of plate extension 59. The procedure continues with the handle subassembly being moved upwardly so that the spring 52 is compressed against surfaces 61 and the spring sitting areas of the upper cavity of handle 41 and so as to allow the extension 59 to be inserted within the upper cavity of handle 41. The subassembly is then moved into slidable abutment with riser 38 such that extension 59 rests within the upper cavity of handle 41 and block 53 partially extends into the walls 58 and rectangular slot 57. Finally, screw 55 is inserted through openings 56 and 57 and is threadedly joined into the threaded aperture 54 of block 53.

Figure 6B:
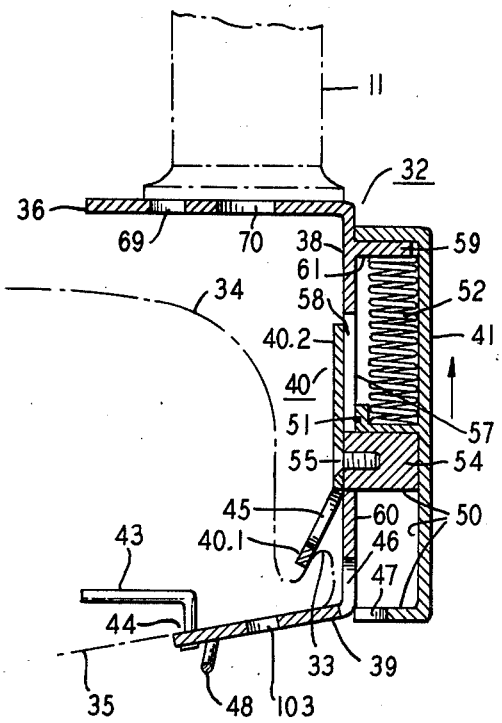
FIG. 6B shows a sectional view of the assembled bracket of FIG. 6A to illustrate a comprssed spring within a slidable handle during a nonengagement of the bracket with the rain gutter of a motor vehicle.
Figure 6A:
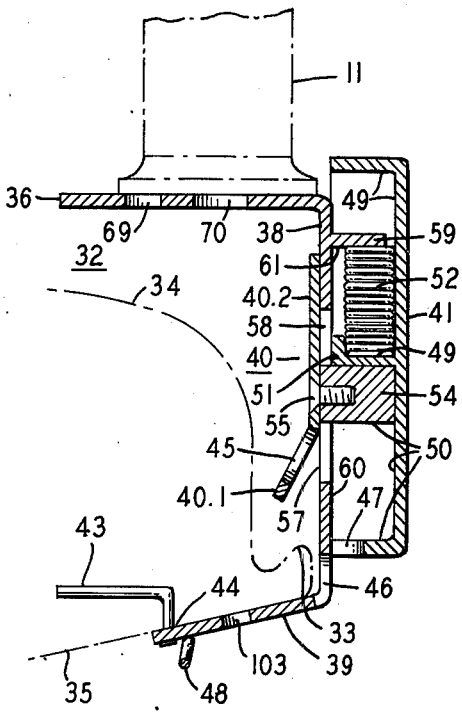
FIG. 6A depicts a sectional view of the assembled bracket of FIGS. 3, 4, and 5 to illustrate a noncompressed spring and the affixing of the bracket to the rain gutter and door abutting surface in the arrangement of FIG. 3.

The manner in which the assembled bracket 32 is installed in and removed from a motor vehicle is perhaps best understood by referring to FIGS. 6A and 6B. First, the door is opened and a pair of spaced apart holes, such as hole 44, is drilled through the inner door frame surface with a suitable template or other guide. Second, the bracket 32 is positioned such that the tips of the pair of rods 42 and 43 (FIGS. 5, 6A, 6B) and then the remainder of those rods are inserted through the drilled holes so that the tread 39 abuts with the inner door frame 35. Third, the handle 41 is moved upwardly for moving plate 40 upwardly so that the inclined extension 40.1 rises and the bracket assembly 32 is movable into the position as shown in FIG. 6A with the extension 40.1 above and in nonembracement with gutter 33. As shown in FIG. 6A, when handle 41 is moved upward, it causes spring 52 to be compressed between extension 59 and wall 49. When handle is released, the compressed spring 52 urges the handle 41 and plate 40 downward so that, as shown in FIG. 6B, the inclined extension 40.1 embraces the gutter 33 within elements 40.1, 38 and 39 for rigidly supporting bracket 32 and the antenna 11.1 on the motor vehicle. The vehicle door may then be closed.

The process for removing the bracket 32 from its installed position is essentially the inverse of those steps just described.

Figure 7:
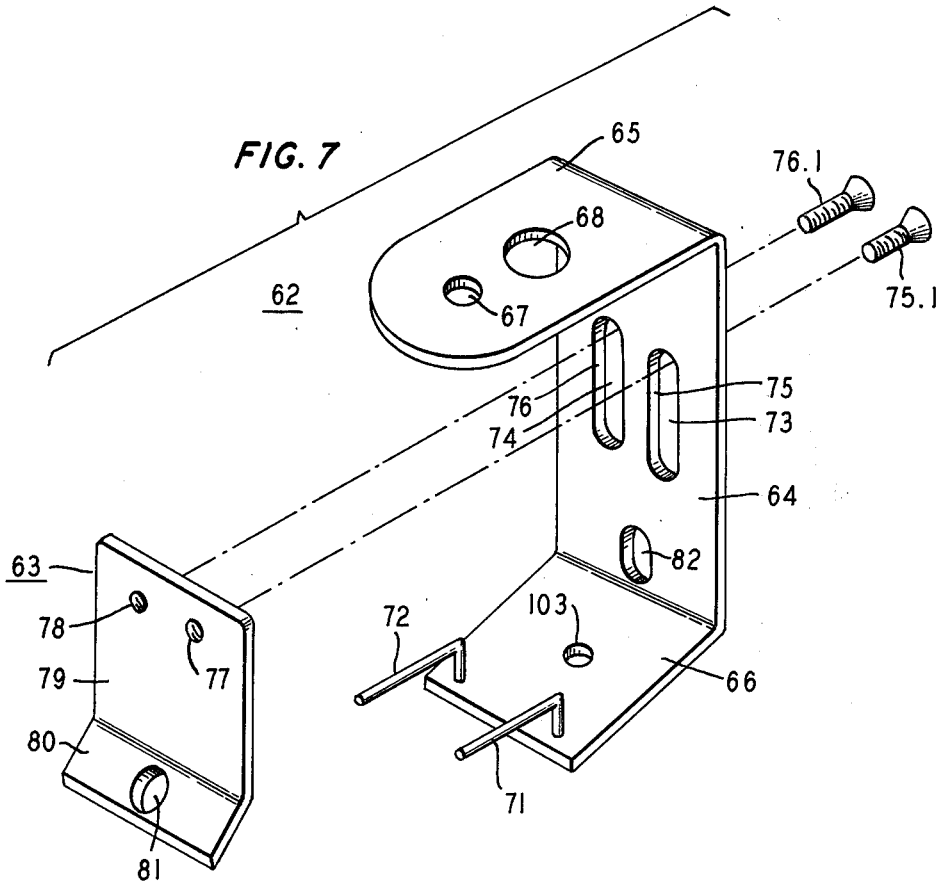
FIG. 7 is an exploded piece part view of another exemplary embodiment of my invention mounting bracket.

FIG. 7 discloses a mounting bracket 62 which is similar to that shown in FIGS. 3 through 6B except that it does not contain the handle-spring subassembly. Instead, it comprises an arrangement whereby a plate 63 is movably secured about a riser 64 by screw means. Bracket 62 comprises upper and lower treads 65 and 66 joined together by the riser 64. Tread 65 contains a pair of apertures 67 and 68 for mounting a CB antenna of different dimensional size. (Similar holes 69 and 70 are shown in FIGS. 5, 6A and 6B for the same purpose.) Lower tread 65 contains a pair of rod extensions 71 and 72 which are insertable through a pair of holes drilled in an inner door frame as priorly described. A pair of spaced apart elongated oval apertures 73 and 74 are formed by wall surfaces 75 and 76 of riser 64. Apertures 73 and 74 receive a pair of screws 75.1 and 76.1 for matingly interfitting with an aligned pair of threaded bores 77 and 78 in a riser 79 of plate 63. The screws 75.1 and 76.1 are initially loosely fitted within bores 77 and 78 so that the plate 63 can be moved vertically away from tread 66 to clear a rain gutter of a motor vehicle during installation of the bracket 62 in a manner similar to that hereinbefore described with respect to the design of FIGS. 6A and 6B. After such an installation, the plate 63 is moved downward to embrace the gutter within an inclined plate extension 80, tread 66 and riser 64. The screws 75.1 and 76.1 are then tightened to secure the bracket 62 and CB antenna onto the motor vehicle. A CB antenna cable is suitable threaded through an aperture 81 in the plate extension 80 and another generally oval aperture 82 in riser 64.

Figure 8:
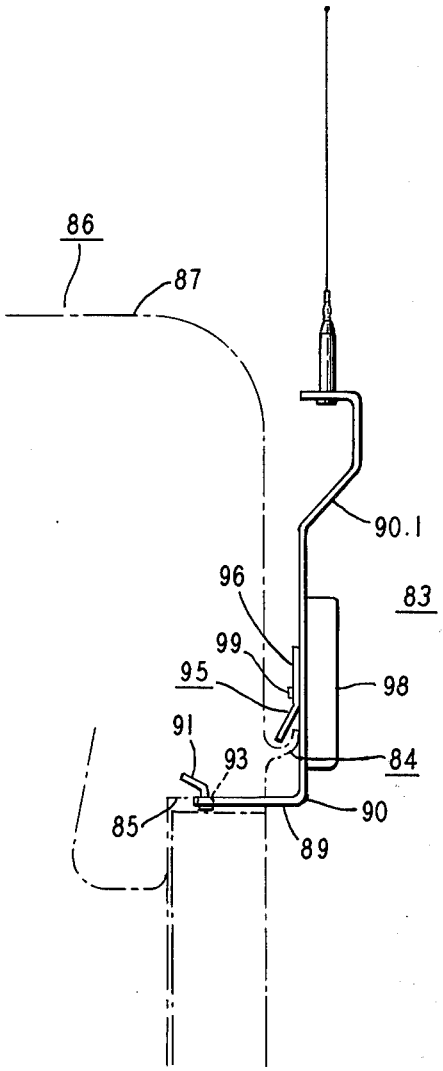
FIG. 8 depicts a CB antenna mounting bracket suitable for mounting on the rain gutter and abutting door frame surface of a high roof of a motor vehicle, such as a truck, trailer cab or van.
Figure 9:
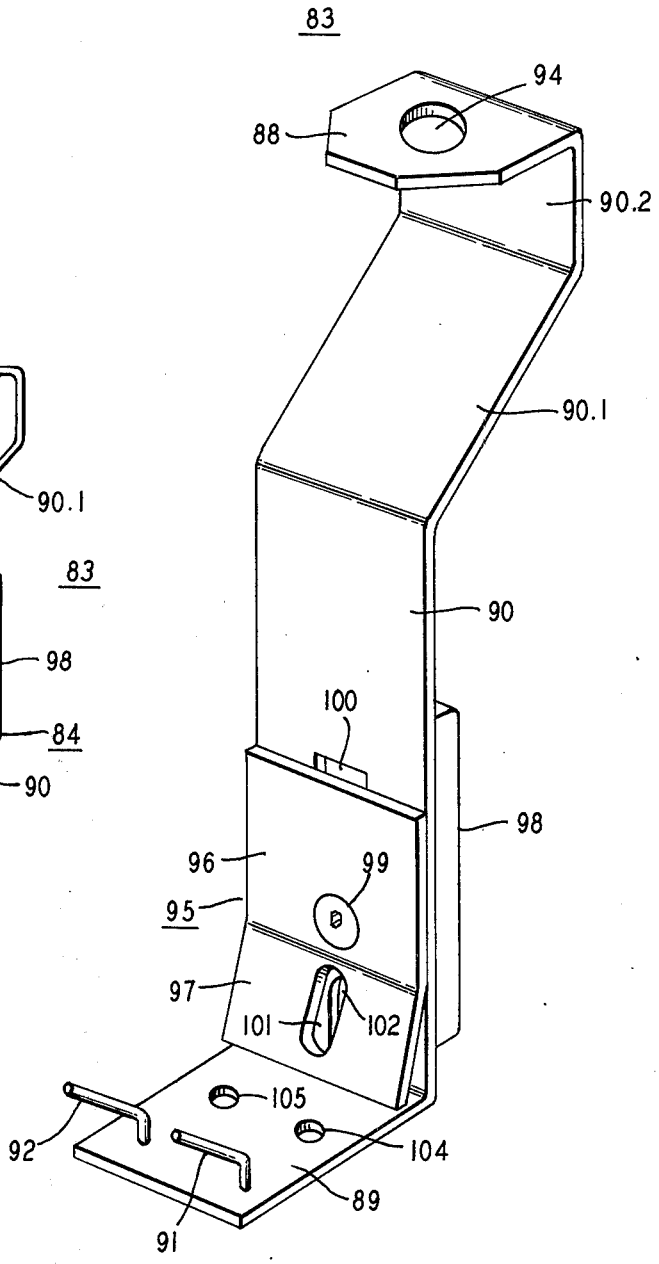
FIG. 9 is a pictorial view of the bracket of FIG. 8.

FIGS. 8 and 9 show a bracket 83 suitable for mounting on a rain gutter 84 and interior door frame surface 85 of a large trailer cab 86 which customarily has a very high roof 87. Bracket 83 comprises upper and lower treads 88 and 89, as well as, a riser 90 extending vertically upward from tread 89 to a contiguous extension 90.1 inclined outwardly away from tread 89 and upwardly toward tread 88 via another vertical riser 90.2. A pair of rod extension members 91 and 92 are secured to tread 89 and are insertable in two holes, such as hole 93, drilled in the inner door frame surface 85 of the trailer cab. Tread 88 has an aperture 94 for mounting a CB antenna. Bracket 83 also comprises a plate 95 having a riser 96 and extension member 97. Riser 96 contains an aperture (not shown) for securing a spring-action handle subassembly 98 to a screw 99 and through a rectangular aperture 100 and by essentially the same process and spring-handle subassembly structure as shown in FIG. 5. Apertures 101 and 102 are formed in plate 95 and riser 90 for confining a CB antenna cable.

It is to be understood that the foregoing is only illustrative of the principles of my invention. In light of my teaching, those skilled in the art can devise other embodiments without departing from the spirit and scope of my invention. For example, it is within my inventive teaching to provide for the semipermanent mounting of the brackets of FIGS. 3, 4, 5, 6A, 7, 8, and 9 by providing the respective means defining holes 103, as well as 104 and 105 for enabling a threaded screw (not shown) to be inserted and fastened into a hole drilled in the inner door frame of a motor vehicle. Such an arrangement would optionally eliminate the need for the extension 42, 43, 71, 72 and 91, 92 and enable a simple structure to be obtained. It is within the scope of my inventive teaching to adapt the various bracket arrangements for mounting on a hatch opening or trunk lid of an automobile with lower tread and rod and/or screw fastener configurations which follow the contours and curvatures of the inner surfaces of the hatch opening or trunk lid. In such applications, the spring-action handle subassembly controls the plate extension embracing the outer surface of the hatch opening or trunk lid.

Reference is made to my copending U.S. patent application Ser. No. 737,552, filed Nov. 1, 1976 which discloses related subject matter.

What is claimed is:

1. A bracket for mounting an antenna to an interior portion of a motor vehicle body frame and about a barrier means which is openable to provide access to the interior of the vehicle and is closable to bar entry into the vehicle, said frame having means defining at least one aperture through a prescribed interior portion thereof and comprising a stepped bracket having a plurality of treads and at least one step riser secured between said treads, a first one of said treads having means for securely mounting said antenna, securing means for a second one of said treads admittable within said at least one aperture upon an opening of said barrier means and for affixing said second one of said treads between said prescribed interior portion of said frame and said barrier means when said barrier means is closed and said securing means comprises a plurality of hook-shaped, spaced apart rod extensions on an upwardly facing surface of said second one of said treads and said defining means comprises means providing a pair of spaced apart apertures through said prescribed interior portion of said frame and for admitting said rod extensions into said interior portion of said frame.

2. A bracket for mounting an antenna to an interior portion of a motor vehicle body frame and about a barrier means which is openable to provide access to the interior of the vehicle and is closable to bar entry into the vehicle, said frame having means defining at least one aperture through a prescribed interior portion thereof and comprising a stepped bracket having a plurality of treads and at least one step riser secured between said treads, a first one of said treads having means for securely mounting said antenna, securing means for a second one of said treads admittable within said at least one aperture upon an opening of said barrier means and for affixing said second one of said treads between said prescribed interior portion of said frame and said barrier means when said barrier means is closed said motor vehicle body comprises a roof having a rain gutter, and said bracket further comprises plate means having a riser removably secured about said step riser of said bracket and a piece extending from said riser of said plate means for embracing said rain gutter to secure said bracket thereto.

3. The invention in accordance with claim 2 wherein said plate means riser has at least one threaded bore, said step riser has at least one slot in alignment with said threaded bore, and further comprising fastener means insertable through said slot and for threadedly interfitting with said threaded bore.

4. The invention in accordance with claim 2 further comprising a handle subassembly movably secured to said plate means about said step riser and vertically movable to admit and embracingly fasten said extending piece of said plate means about said rain gutter.

5. The invention in accordance with claim 3 wherein said handle subassembly comprises a handle, means defining a cavity means within said handle, spring means, said cavity means including means for confiningly sitting said spring means, a block means within said cavity means and having a threaded aperture, said step riser having a slot for a guiding movement of said block means therein, said plate means riser having means defining an aperture, screw means extending through said last-mentioned aperture for threaded interfitting with said threaded aperture of said block means and for movable fastening said plate means to said block means, and an extension member protruding from said step riser and compressively engaging said spring means within said cavity means.

6. A bracket for mounting an antenna to an interior portion of a motor vehicle body frame and to an exterior gutter on a roof of said vehicle, said frame having means defining aperture means through a prescribed portion of said interior of said vehicle, and comprising a stepped bracket having a plurality of treads and at least one step riser secured between said treads, a first one of said treads having means for mounting said antenna, means for fastening said bracket within said aperture means to said gutter including means located on a second one of said treads for securing said second tread to said aperture means in said frame, and means slidable on said riser and movable for embracing said gutter to fasten said bracket thereto.

7. The invention in accordance with claim 6 wherein said embracing means comprises means defining at least one threaded bore, said step riser has at least one slot in alignment with said threaded bore, and further comprising fastener means insertable through said slot and for threadedly interfitting with said threaded bore.

8. The invention in accordance with claim 6 wherein said embracing means includes a handle subassembly movably secured about said step riser and a device fastenably secured to said handle subassembly and responsive to vertical movement of said subassembly for embracing said gutter to secure said bracket thereto.

9. The invention in accordance with claim 8 wherein said embracing device comprises plate means having a riser fastened to said handle subassembly and a piece for embracing said rain gutter to secure said bracket thereto.

10. The invention in accordance with claim 9 wherein said handle subassembly comprises a handle, means defining a cavity means within said handle, spring means, said cavity means including means for confiningly sitting said spring means, block means within said cavity means and having a threaded aperture, said step riser having a slot for guiding movement of said block means therein, said embracing device riser having means defining an aperture, screw means extending through said last-mentioned aperture for threadedly interfitting with said threaded aperture of said block means and for movably fastening said plate means to said block means, and an extension member protruding from said step riser and compressively engaging said spring means within said cavity means.

11. The invention in accordance with claim 6 wherein said aperture means comprises a pair of apertures, said means admittable within said aperture means comprises a pair of spaced apart rods extending from said second one of said treads and each of said rods admittable into an individual one of said pair of apertures for securing said bracket therein.

12. The invention in accordance with claim 6 wherein said second one of said treads comprises means defining a hole, and said means admittable within said aperture means comprises a screw fastener insertable through said last-mentioned hole and threadedly interfitting within said aperture means for fastening said bracket thereto.

13. A bracket for mounting an antenna to an interior portion of a motor vehicle body frame and to an exterior gutter on a roof of said vehicle, said frame having means defining aperture means through a prescribed portion of said interior of said vehicle, and comprising a stepped bracket having an upper tread having means for mounting said antenna, a first riser extending vertically downward from said tread, an extension inclined downward and inwardly from said riser, a second riser extending vertically downward from said extension, a lower tread joined to a lower portion of said second riser, means extending upward from said lower tread and insertable into said aperture means, plate means having a riser and an extension device therefrom, a slidable handle means, said plate means riser having an aperture, said second riser having an opening, and means insertable through said aperture and said opening for fastening said plate means to said handle means, and said plate means movable in response to a sliding of said handle means for effecting an embracing of said gutter by said plate means extending means.

* * * * *